US010440793B1

(12) United States Patent
Wilde

(10) Patent No.: US 10,440,793 B1
(45) **Date of Patent: *Oct. 8, 2019**

(54) UNIVERSAL WIRELESS LUMINAIRE CONTROLLER AND METHOD OF USE

(71) Applicant: California Eastern Laboratories, Inc., Santa Clara, CA (US)

(72) Inventor: David E. Wilde, Cary, IL (US)

(73) Assignee: California Eastern Laboratories, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/257,257

(22) Filed: Jan. 25, 2019

Related U.S. Application Data

(63) Continuation of application No. 16/046,259, filed on Jul. 26, 2018.

(51) Int. Cl.
*H05B 33/08* (2006.01)
*H05B 37/02* (2006.01)

(52) U.S. Cl.
CPC ..... *H05B 33/0857* (2013.01); *H05B 33/0827* (2013.01); *H05B 37/0272* (2013.01)

(58) Field of Classification Search
None
See application file for complete search history.

(56) References Cited

U.S. PATENT DOCUMENTS 9,655,213 B2 * 5/2017 Cho ..... H05B 37/0272

* cited by examiner

*Primary Examiner* — Dedei K Hammond
(74) *Attorney, Agent, or Firm* — Richard W. James

(57) ABSTRACT

An apparatus and method for controlling a universal wireless luminaire. The method includes controlling a separate memory device, a radio, a relay for switching power to a luminaire, two zero to ten volt luminaire control outputs, a tunable white temperature luminaire control output, a universal asynchronous receiver-transmitter, and a hardware switch with a single microcontroller.

20 Claims, 5 Drawing Sheets

UNIVERSAL WIRELESS LUMINAIRE CONTROLLER AND METHOD OF USE

CROSS-REFERENCE TO RELATED APPLICATIONS

The present application is a continuation of U.S. patent application Ser. No. 16/046,259, filed Jul. 26, 2018, which is incorporated herein in its entirety.

FIELD OF THE INVENTION

This invention is related to luminaire control, and more particularly to apparatuses and methods for controlling power to and the intensity of an LED luminaire and that can also control the color temperature of the luminaire.

BACKGROUND OF THE INVENTION

A variety of device are available for powering a variety of luminaires. Types of luminaires including LED luminaires, fluorescent luminaires, incandescent luminaires, and halogen luminaires, for example. There are also a variety of signals used to control the intensity of luminaires and the color temperature of tunable white light LED luminaires. Furthermore, a variety of methods and apparatuses are used for each of those control operations. Control signals for LED luminaires can include a binary power on/power off control, a 0-10V dimming control signal, a 0-10V light color control signal, and a Digital Addressable Lighting Interface (DALI) control signal to communicate energization, intensity, and color of a luminaire. Apparatuses also exist for pulse-width-modulated (PWM) signal interfaces, phase-cut dimming, and for implementing a radio for wireless connectivity and control of the luminaire.

Thus, there is a need for a single device to control LED luminaires by way of various control signals.

In addition, there is a need to control tunable white luminaires, which may contain more than one LED light string with a single luminaire control device.

There is also a need for a control that has the flexibility of satisfying the variety of control signal requirements.

BRIEF DESCRIPTION OF THE DRAWINGS

The accompanying drawings, wherein like reference numerals are employed to designate like components, are included to provide a further understanding of universal wireless luminaire control apparatuses and methods, are incorporated in and constitute a part of this specification, and show embodiments of those apparatuses and methods that together with the description serve to explain those apparatuses and methods.

Various other objects, features and advantages of the invention will be readily apparent according to the following description exemplified by the drawings, which are shown by way of example only, wherein.

SUMMARY OF THE INVENTION

Figure 1:
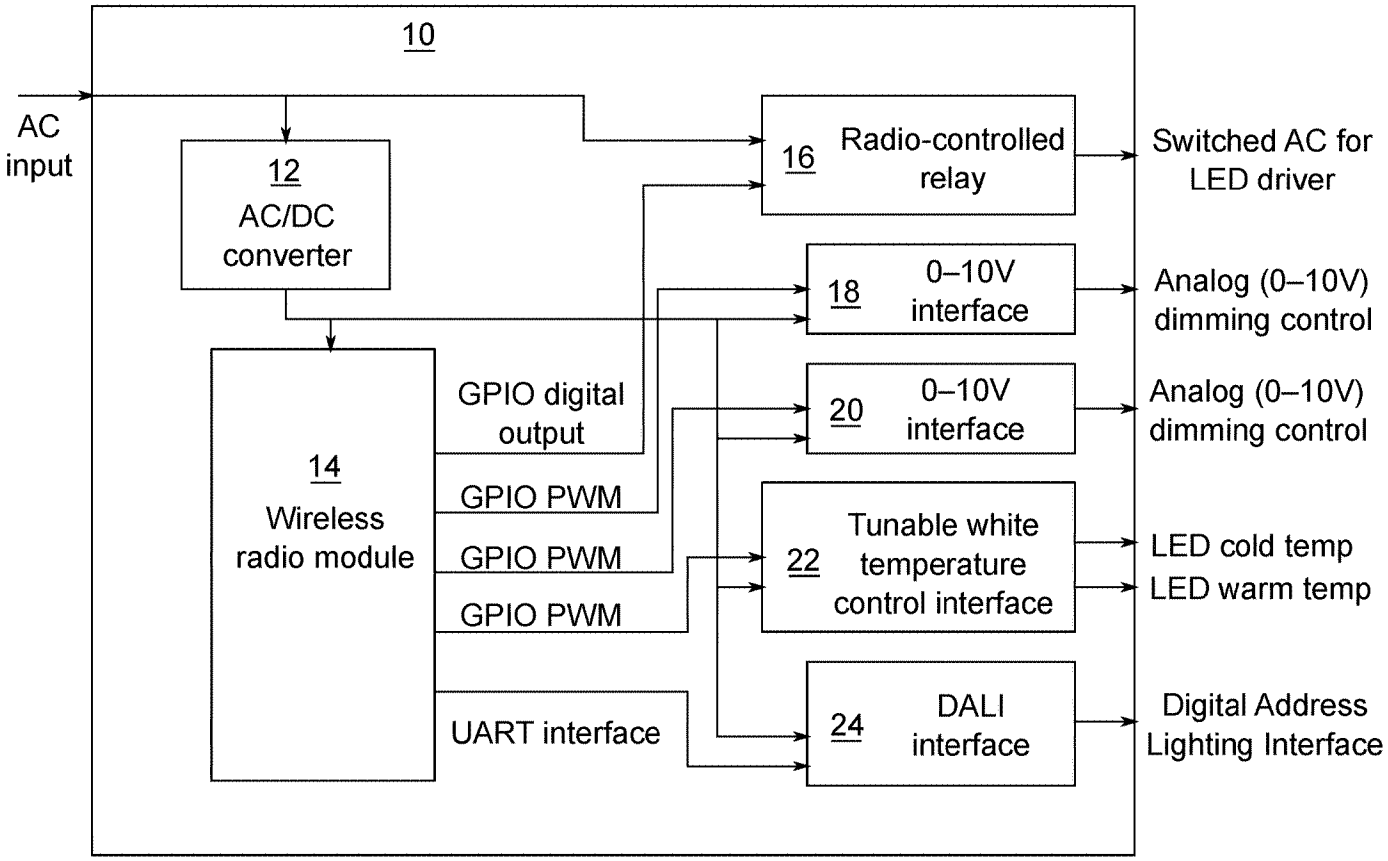
FIG. 1 illustrates a block diagram of an embodiment of a universal wireless luminaire controller.

In an embodiment, a wireless luminaire control device includes: a single microcontroller, a separate memory device coupled to the single microcontroller, a radio coupled to the single microcontroller for communication with a wireless luminaire, a relay coupled to the single microcontroller for switching power for the luminaire, a first microcontroller pulse width modulated output coupled to a zero to ten volt driver interface to provide a first control signal for the luminaire, a second microcontroller pulse width modulated output coupled to a zero to ten volt driver interface to provide a color temperature control signal for the luminaire, a third microcontroller pulse width modulated output coupled to a tunable white temperature control interface to provide a color control signal for the luminaire, a fourth microcontroller pulse width modulated output actuating a first MOSFET coupled to a first colored LED array and actuating a second MOSFET coupled to a second colored LED array through a logic inverter gate, an interface coupled to the universal asynchronous receiver-transmitter to output a control signal for the luminaire in a digital lighting control protocol, and a hardware switch that causes the single microcontroller to execute instructions to join a wireless network when the hardware switch is actuated. The separate memory device contains instructions for operation of the single microcontroller and may allow additional memory space for storing data received by the radio. This data can be a new firmware image for the controller or data on the health of the system. The memory device may store this information and automatically download those instructions to the single microcontroller when the single microcontroller and separate memory device are energized.

In another embodiment, a method of controlling a universal wireless luminaire, includes controlling a separate memory device, a radio, a relay for switching power to an LED luminaire, two zero to ten volt luminaire control outputs, a tunable white temperature luminaire control output, a DALI signal output, constant current driver output color control, and a hardware switch with a single microcontroller. The separate memory device in that embodiment may download operational instructions to the single microcontroller when the single microcontroller and separate memory are energized. The radio of that embodiment may receive a control signal from a remote wireless luminaire control device. The relay in that embodiment may switch power to the luminaire. The hardware switch of that embodiment may furthermore energize and de-energize the universal wireless luminaire when the hardware switch is actuated.

Other embodiments, which may include one or more parts of the aforementioned apparatus and method or other parts, are also contemplated, and may have a broader or different scope than the aforementioned apparatus and method. For example, some microcontrollers may be able to generate many PWM signals which can then be used to create additional 0-10V control signals. Thus, the embodiments in this Summary of the Invention are mere examples, and are not intended to limit or define the scope of the invention or claims.

DETAILED DESCRIPTION

Reference will now be made to embodiments of universal wireless luminaire control apparatuses and methods of using a universal wireless luminaire control, examples of which are shown in the accompanying drawings. Details, features, and advantages of universal wireless luminaire control apparatuses and methods of use will become further apparent in the following detailed description of embodiments thereof.

Any reference in the specification to "one embodiment," "a certain embodiment," or a similar reference to an embodiment is intended to indicate that a particular feature, structure or characteristic described in connection with the embodiment is included in at least one embodiment of the invention. The appearances of such terms in various places in the specification do not necessarily all refer to the same embodiment. References to "or" are furthermore intended as inclusive, so "or" may indicate one or another of the ored terms or more than one ored term.

FIG. 1 is a block diagram of an embodiment of a universal wireless luminaire control 10. The universal wireless luminaire controller 10 includes an AC/DC converter 12, a wireless radio module 14, a relay 16, a first channel interface 18, a second channel interface 20, a tunable white temperature control interface 22, and a digital lighting control protocol interface 24.

The universal wireless luminaire control 10 AC/DC alternating current to direct current converter 12 may be coupled to alternating current line electrical power to receive power and may convert that line power and output direct current electrical power to the wireless radio module 14, the relay 16, the first channel interface 18, which may provide a first 0-10V output signal, the second channel interface 20, which may provide a second 0-10V output signal, the tunable white temperature control interface 22 that controls an LED color or what is commonly referred to as "temperature" control output, and the digital lighting control protocol interface 24.

The AC/DC converter 12 can be any of many devices available to convert alternating current, such as 120 VAC operating at 60 Hz or 230 VAC operating at 50 Hz to a direct current appropriate for powering the wireless radio 14, relay 16, first interface 18, second interface 20, tunable white temperature control interface 22, and digital address lighting interface 24. The implementation of the AC/DC converter 12 can be a self-contained component or made up of discrete components to achieve the conversion from AC to DC as required.

The AC/DC converter may be coupled to a building power supply and may generate approximately a 3.3 VDC output to be provided to certain components 14, 16, and 22 of the universal wireless luminaire control 10 and approximately 12-16 VDC for other components, such as the 0-10V interfaces 18, 20 and the DALI interface 24. The AC/DC converter may alternately provide different output voltages as desired.

Figure 3:
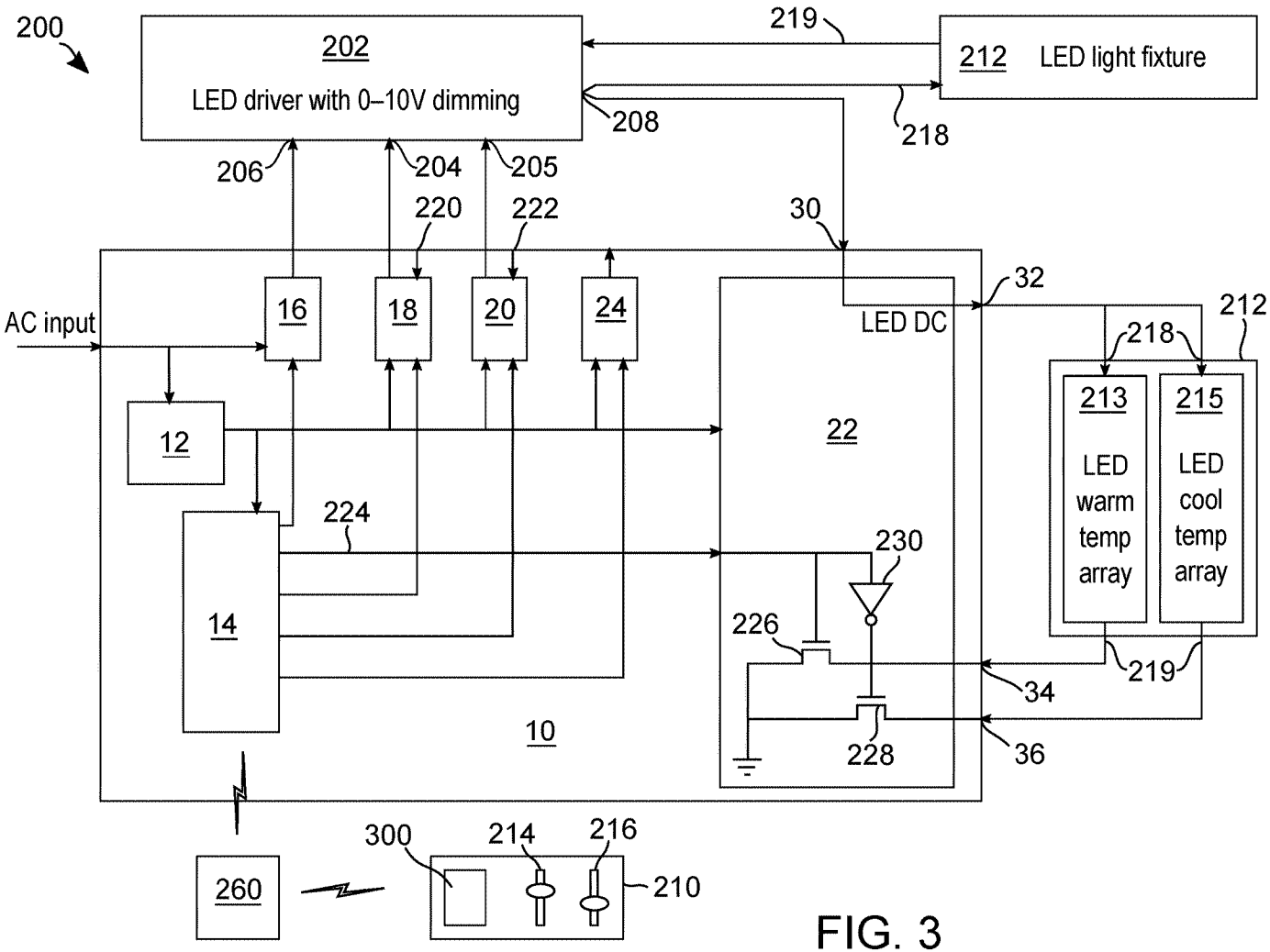
FIG. 3 illustrates an embodiment of an LED luminaire installation.

The wireless radio 14 receives and transmits wireless control information, for example, using an IEEE 802.11 WiFi, Bluetooth, Zigbee, or proprietary 802.15.4 protocol. The wireless radio 14 may transmit information, such as lighting status, level, and color information to an LED light fixture 212 and that transmission may occur through a gateway to a driver 202 that provides an appropriate direct current to operate the LED light fixture 212 as is illustrated in FIG. 3. The wireless radio 14 may also or alternately transmit or receive information to another device. For example, the wireless radio 14 may receive luminaire control information from a user interface which may, for example, be a computing device or a manually actuated device such as the dimmer 214. Those transmissions may furthermore occur through the gateway. The wireless radio 14 may also or alternately receive information or instructions from the gateway or another device coupled to the network 256 and those instructions may provide information regarding how the LED fixture 212 is to be controlled.

The wireless radio module 14 may, for example, be a Cortet® model ZICM357SPx or ZICM3588SPx MeshConnect™ RF module and may include a radio transceiver with a baseband modem to manage radio functions, a microcontroller with internal RAM and flash memory, and a hardwired media access control (MAC) address. Other radio modules could be used to achieve the same functionality.

The MAC address may provide the wireless radio module 14 with a unique identifier so that wireless radio module 14 may be found on a network, such as a mesh network. The wireless radio module 14 may, for example, provide multiple general-purpose input and output (I/O) connections used to implement the functionality of the relay 16, first interface 18, second interface 20, tunable white temperature control interface 22, and digital address lighting interface 24 and a universal asynchronous receiver-transmitter (UART) connection for serial communications.

The relay 16 may be any device that is capable of switching electrical power to a lighting fixture, such as an LED driver 202. The relay 16 may include an electrical contact rated to switch line voltage alternating current power. The relay 16 may energize the lighting fixture 212 through the LED Driver 202, thereby allowing power to flow to the lighting fixture 212, when in an on or closed position and de-energize, thereby preventing power from flowing to the lighting fixture 212, when in an off or open position. The relay 16 may furthermore receive a signal from the wireless radio module 14 that switches the relay 16 between its on and off states. Thus, the relay 16 may actuate the lighting fixture 212 to be energized and illuminated when the relay 16 is in its on or closed position and actuate the lighting fixture to be de-energized and not illuminated when the relay 16 is in its off or open position.

Figure 2:
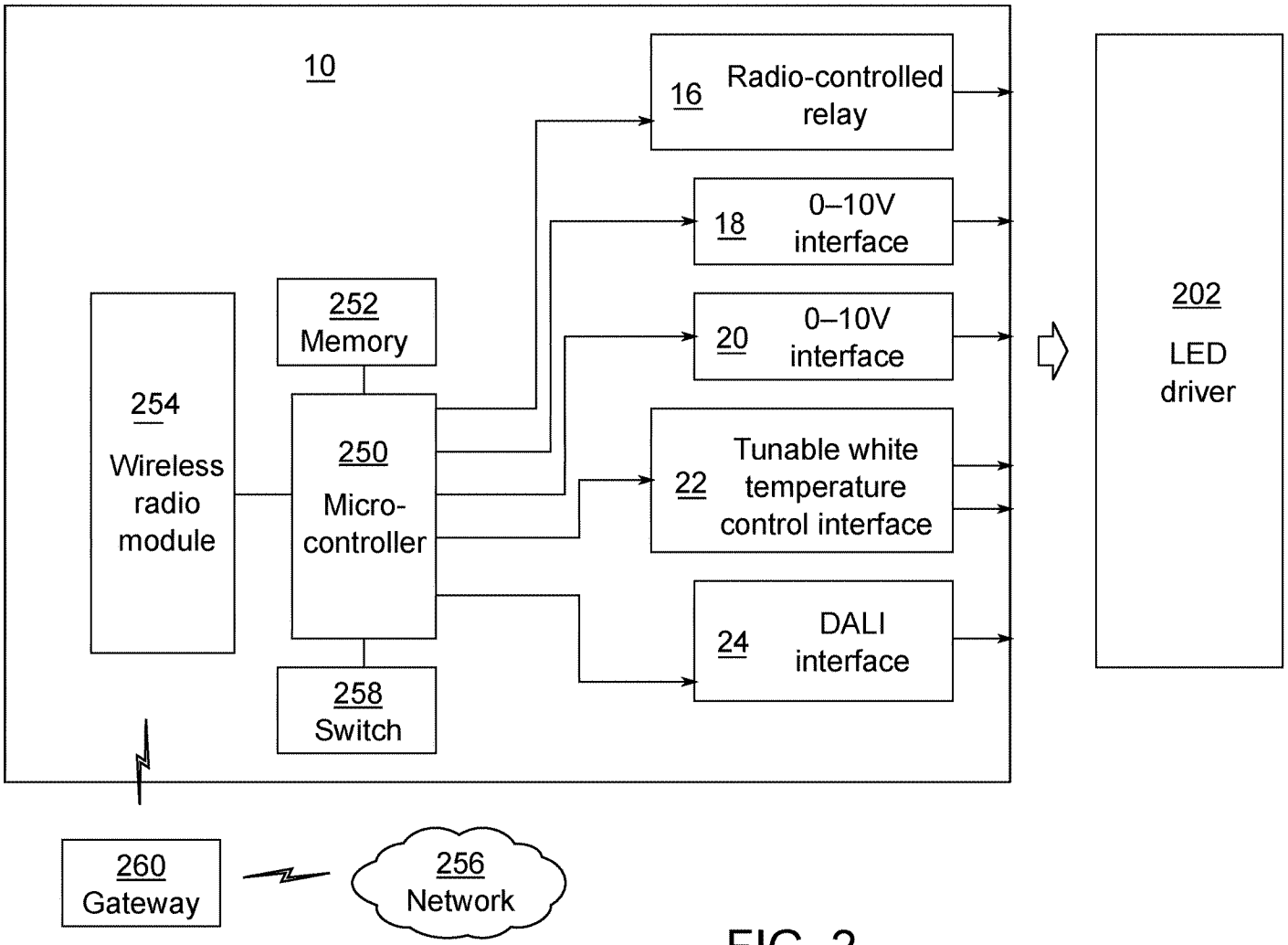
FIG. 2 illustrates a block diagram of another embodiment of a universal wireless luminaire controller.

The first and second interfaces 18 and 20 may each provide a 0-10V control signal and may each include circuitry for converting a digital pulse-width modulated (PWM) signal to an analog 0-10 VDC signal. The 0-10V interfaces may, thus, receive a PWM signal from the wireless radio module 14, convert that PWM signal to a 0-10 VDC control signal, and output the 0-10 VDC control signal to an LED driver 202, which in turn controls the luminaire 212 in accordance with the 0-10 VDC control signal. Conversion of the PWM signal may be performed by coupling the PWM signal to a low-pass filter in series with a transistor. The output of that combination of the transistor and low-pass filter may convert the PWM signal to a 0-10V signal for control of the lighting fixture 212 through the driver 202, as illustrated in FIG. 2. The 0-10 VDC signal may furthermore be provided to the lighting fixture controller to control the brightness, color temperature, or another aspect of the light output by the lighting fixture coupled to and controlled by the lighting fixture controller.

In another embodiment, the universal wireless luminaire controller 10 may detect the presence of dimming control at the LED driver 202. In that embodiment, the first channel interface 18 may be coupled to an analog to digital converter input (ADC) 220 on the universal wireless luminaire controller 10. In such an embodiment, if the LED driver 202 that the 0-10V first channel interface 18 is connected to has a dimming feature or is otherwise adapted to be coupled to a 0-10V signal, the LED driver 202 will be a 10V source, providing 10 volts unless the driver 0-10V output 18 or 20 modifies that voltage. If the 10V source is detected at the ADC input 220, it can be determined that the driver 202 is generating the 10V and is configured to receive a dimming control signal. A general purpose input output (GPIO) can be used as an indicator of the presence of the 10V source in one embodiment. In that embodiment, the GPIO will be high if the 10V signal is detected and the GPIO will be low if the 10V source is not detected.

A second dimming signal detection can also be provided on the universal wireless luminaire controller 10 second channel interface 20 by coupling the output of the second channel interface 20 to a second input 222 on the universal wireless luminaire controller 10.

The digital lighting control protocol interface 24 may, for example, be a digital addressable lighting interface (DALI), a DMX512 interface or another desired type of digital lighting control protocol. Where, for example, the digital lighting control protocol interface 24 is a DALI interface, the digital lighting control protocol interface 24 may receive instructions in a DALI protocol from the wireless radio module 14 and translate those instructions to the DALI protocol. The translated instructions may then be output to a DALI driver by, for example, shifting a voltage level of the signal to a 0V/16V signal that is required by the DALI standard. The signal to be sent to the DALI interface may be transmitted from the microcontroller in a universal asynchronous receiver-transmitter (UART) protocol and may be transmitted through a UART interface.

FIG. 2 illustrates an embodiment of the universal wireless luminaire controller 10 that includes a single microcontroller 250 that provides computational functionality for all components of the universal wireless luminaire controller 10. The universal wireless luminaire controller 10 also contains a memory device 252 separate from and coupled to the single microcontroller 250. The separate memory device 252 contains instructions for operation of the single microcontroller 250. In certain embodiments, when the universal wireless luminaire controller 10 is de-energized and then re-energized, the microcontroller 250 downloads software from a central device and loads that software, which includes instructions for operation of the microcontroller 250 onto the separate memory device 252.

The universal wireless luminaire controller 10 illustrated in FIG. 2 also includes a radio 254. That radio 254 may communicate wirelessly with other devices in a wireless network 256. The wireless network may be a mesh network and may, for example, operate using a ZigBee protocol. For example, the universal wireless luminaire controller 10 may communicate with a wireless luminaire control device, which may be mounted on a wall for operation by a user or carried by a luminaire user and may permit the user to control energization, intensity, or color of the luminaire.

The universal wireless luminaire controller 10 of FIG. 2 may also include a relay for switching power to the luminaire, one or more zero to ten volt drivers to each provide a control signal to the luminaire, a digital addressable lighting interface (DALI) to provide a control signal to the luminaire, and a driver for a constant current output to provide power to an LED fixture 212.

The relay 16 may be driven by a digital output provided by the single microcontroller 250.

In the embodiment illustrated in FIG. 2, the relay 16 switches the line voltage alternating current to energize and de-energize one or more LED lighting fixtures. In such an embodiment, each of the 0-10V outputs may serve as a control signal to control the lighting intensity or color of the LED lighting fixture or lighting string. Furthermore, in certain embodiments, the radio 14 may provide pulse-width-modulated (PWM) signals to one or more 0-10V interfaces 18 or 20 and the 0-10V interface 18, 20 may convert that PWM signal to a corresponding 0-10V modulated signal used to control an aspect of an LED string or fixture 212 by interfacing to a driver 202 with the appropriate inputs.

In an embodiment, an LED fixture 212 is coupled to a driver 202 that receives line voltage power that is switched by the relay 16 of the universal wireless luminaire control 10 and a 0-10V intensity dimming signal from one of the 0-10V interfaces 18 or 20 that provides a light intensity signal to control the light intensity of the LED light fixture 212. The LED light fixture 212 may also receive another signal from the universal wireless luminaire control 10 that indicates to the LED light fixture 212 what color or temperature the light emanating from the LED fixture 212 should be. For example, an LED light fixture 212 can provide what appears to be and is commonly referred to as a warm color of light, a cool color of light, or a color that is between warm and cool. That color may furthermore be controlled by a control signal emanating from the universal wireless luminaire control 10, such as the tunable white temperature control interface 22 of the universal wireless luminaire control 10.

One or more of the 0-10V drivers 18 and 20, the DALI interface 24, the tunable white temperature control interface 22, and a constant current output 30 may be driven by pulse-width-modulated or UART signals provided from the microcontroller 250. The 0-10V driver may furthermore convert the PWM signal received from the microcontroller 250 to a 0-10V signal that is standard in the lighting control industry and transmit that 0-10V signal to the lighting fixture 212. That 0-10V signal transmitted to the lighting fixture 212 may correspond to a brightness level that the luminaire LED fixture 212 should be providing or a color or other aspect of light provided by the luminaire fixture 212.

The universal wireless luminaire controller 10 illustrated in FIG. 2 may also include a hardware switch 258 that causes the single microcontroller 250 to execute instructions to join the wireless network 256 when the hardware switch 258 is actuated. The universal wireless luminaire controller 10 may, furthermore, download instructions for its performance to be stored in the separate memory 252 and executed by the microcontroller 250 when the universal wireless luminaire controller 10 joins the network 256.

FIG. 3 illustrates an embodiment of an LED light fixture installation 200. The LED light fixture installation 200 of FIG. 2 includes an LED driver 202 with at least one signal input 204, a power input 206, and an LED power output 208. An embodiment of a universal wireless luminaire controller 10 and an LED fixture 212 are also included in the LED light fixture installation 200.

The LED driver 202 may be connected to the LED light fixture 212 input 218 at its LED power output 208 with a return 219 by wire. The LED driver 202 may be coupled to a user control 210 at its input by either wire or wirelessly.

In the embodiment illustrated in FIG. 3, the universal wireless luminaire controller 10 provides one or more signals or power to the LED driver 202 and the LED driver 202 provides appropriate power to the LED fixture 212 commensurate with the power and signals received at the LED driver 202 from the universal wireless luminaire controller 10.

In an embodiment, the LED driver 202 may be connected by wire directly to line alternating current at the power input 206 and may provide a constant current power output to the LED fixture 212 in accordance with one or more signals received at the LED driver 202 input 204 from the universal wireless luminaire controller 10.

The LED power output 208 may be a constant current output that is created from the line alternating current received at the LED power input 206 and that power may be provided to one or more LED fixtures 212, wherein each fixture 212 may contain more than one string of different color LEDs.

The LED driver 202 first input 204 may be configured to receive a 0-10V dimming signal from the universal wireless luminaire controller 10, as is illustrated in FIG. 3 or another type of signal output by the universal wireless luminaire controller 10. The LED driver 202 may include one or more additional inputs 205 to receive one or more additional control signals, which may, for example, be 0-10V signals or another desired signal and may, for example, control what is commonly referred to as the warmth of the light that is to be output by the lighting fixture 212.

The user control 210 may have one or multiple functions. One of those functions may be an on/off control that may be actuated by a user to energize and de-energize the LED fixture 212. Another function of the user control 210 may be dimming. Yet another function of the user control 210 may be a lighting color temperature control that varies the color of the light emitted by the LED fixture 212 between what are generally referred to as a warm light and a cool light. Other user control functions desired may also or alternately be performed through the user control 210.

User control functionality may be performed in various ways desired, including through a manually actuated dimmer switch or a user actuated computer control.

In one embodiment, the user control 210 includes a manually actuated slide type of dimming control 214 that may be positioned over a linear range and is often moved manually in a vertical orientation. That manually actuated slide control 214 may be moved throughout its linear range from top to bottom. In such a configuration, the LED fixture 212 may be de-energized when the control switch is in the lowest position of its slide, the LED fixture 212 may be energized at a low lighting level when the manually actuated slide control 214 is moved upward a small amount from the lowest position of its slide, the lighting level of the LED fixture 212 may increase gradually as the manually actuated slide control 214 is slid upward more, and the LED fixture 212 may be energized at its brightest level when the manually actuated slide control 214 is slid to the top of its vertical range. Such a manually actuated control may include more than one switch or slide and may include a radio for communication with the universal wireless luminaire controller 10. Communication between the user control 210 and universal wireless luminaire controller 10 may furthermore by performed through the gateway 260.

In an embodiment, the user control 210 performs an additional second function to modulate light from the LED fixture 212 from what is commonly referred to as a cool light to a warm light. In an embodiment, the control may be or include a manually actuated control 216 that may be manipulated, for example by sliding, to control the temperature of the light emitted from the LED fixture 212. In such an embodiment, the second manually actuated control 216 may cause the LED fixture 212 to emit its warmest light at a first end of the second manually actuated control 216 range, its coolest light at a second end of the second manually actuated control 216 range, and may modulate between cool and warm light when moved between the first and second ends of the second manually actuated control 216.

In an embodiment in which the user control 210 is coupled wirelessly to the universal wireless luminaire controller 10, a radio board 300 may be incorporated into the user control 210 to communicate with other radio boards such as radio board 14 in the universal wireless luminaire controller 10 such that the user control 210 may transmit information to the universal wireless luminaire controller 10 by way of those radios 300 and 14. In certain embodiments, the universal wireless luminaire controller 10 may also communicate a control signal to the user control 210. Communication between radios 300 and 14 may be performed via gateway 260.

In one embodiment, the universal wireless luminaire controller 10 provides color control of a constant current driver 202 output 208 using a single output 32 that controls driver constant current 30 to two separate LED strings 213 and 215. Those two LED strings 213 and 215 may be different colors and, therefore, the control may vary the color temperature output of a fixture 212 containing those two separate LED strings.

In an embodiment of color control of a constant current driver 202 output 208, an LED DC input 32 of the Universal wireless luminaire controller 10 takes the constant current output 208 from the driver 202 and directs it to the LED strings 213 and 215 from output 32. Each of the LED strings 213 and 215 is associated with an LED DC return 34 and 36. Those returns 34 and 36 include circuitry that permit a universal wireless luminaire controller 10 output 224 to control which LED string 213 and 215 the constant current driver 202 output 208 flows through, thereby controlling the color of the light provided by the fixture 212. In such an embodiment, the universal wireless luminaire controller 10 may provide direct current received from an LED driver 202 to illuminate the LED fixture 212 on the LED DC output 32 to one or more LED fixtures 212. The connection between the LED DC output 32 and the LED fixture 212 may be made with wire. The LED returns 34 and 36 can complete the LED DC power circuit by receiving a return wire from each string 213 and 215 in the LED fixture 212.

In the embodiment illustrated in FIG. 3, a light intensity signal may be transmitted from the universal wireless luminaire controller 10 at, for example, the first channel interface 18, and that light intensity signal may be transmitted by wire to an LED driver 202. The LED driver may output a direct current from the LED power output 208 appropriate to power the LED fixture 212 to the desired intensity. In an embodiment that does not include color temperature control, that output 208 may be coupled directly to the LED fixture 212 at 218, as is illustrated in FIG. 3. In an embodiment where the universal wireless luminaire controller 10 is to control color temperature, however, the driver 202 output 208 may be coupled to the universal wireless luminaire controller 10 driver constant-current output at 30. The universal wireless luminaire controller 10 may vary the current flowing through each LED string 213 and 214, for example using a PWM signal from the wireless radio module 14, to alternate a constant current and voltage between one color LED string and another color LED string to create a desired color temperature emanating from the LED fixture 212.

In an embodiment, the tunable white temperature control interface 22 may include circuitry that converts the PWM signal to two complementary signals to control the color of two different color LED strings in a lighting fixture 212. In such an embodiment, direct current received at the driver constant current output 30 from the driver 202 is output to an LED fixture 212 having a warm color temperature string 213 and a cool color temperature string 215. The LED DC return 34 for the warm string 213 may include a MOSFET 226 and the LED DC return 36 for the cool string 215 may include a logic inverter gate 230 and a MOSFET 228. In such an embodiment, a PWM control signal drives the gate terminal of the first MOSFET switch 226 and indirectly drives the gate terminal of the second MOSFET switch 228 through the inverter 230. The inverter 230 assures that the first and second MOSFETs 226 and 228 are always in opposite conductive states, with the result that the driver constant current 208 from driver 202 is alternated between the warm and cool LED strings 213 and 215 of the LED fixture 212. The ratio of on time to off time in each LED string blends the two colors to allow a continuous change in color temperature based on the duty cycle of the PWM signal.

In an embodiment, the tunable white temperature control interface 22 may include circuitry that converts a PWM signal to two complementary signals to control the color of two different color LED strings in a lighting fixture 212. In one such embodiment, the color of a string of LED lights may be said to range from "cool" to "warm." The first of the PWM signals transmitted from the tunable white temperature control interface 22 may be transmitted to an LED driver 202 or, alternatively, to a "cool" LED string. The second color control signal may also be transmitted from the tunable white temperature control interface 22 to the LED driver 202 or to a "warm" LED string. The tunable white temperature control interface may contain an inverter to generate an inverted PWM signal, so that both PWM and inverted PWM signals may be used to separately control the warm and cool LED strings. The two LED strings of different temperatures are thus driven in a complementary manner, resulting in varying color temperatures of light emitted from the fixture 212 as the duty cycle of the PWM signal varies.

Figure 4:
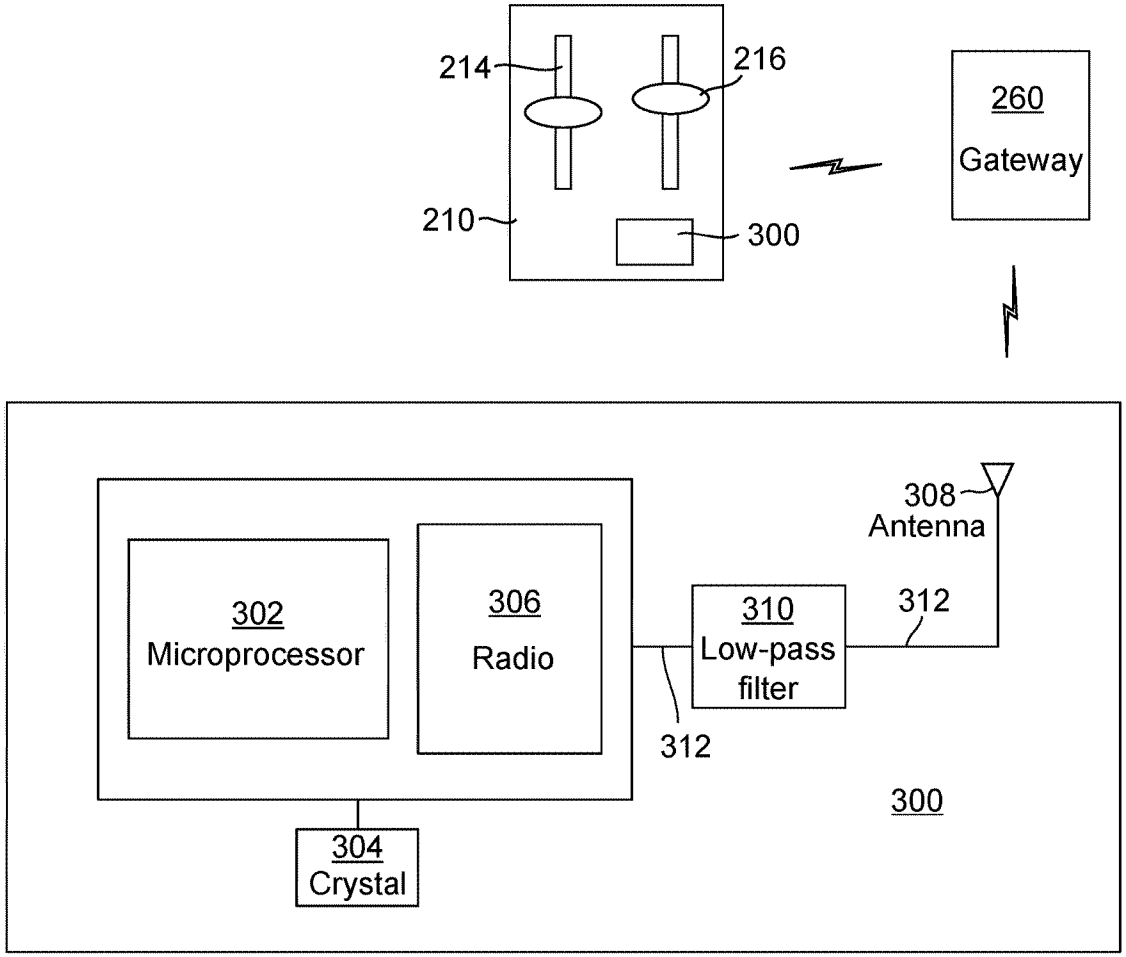
FIG. 4 illustrates an embodiment of a radio board.

FIG. 4 illustrates an embodiment of a radio board or module 300. The radio board 300 includes a microprocessor 302, a timer crystal 304, a radio transceiver 306, and an antenna 308. The radio board or module 300 may also include a low-pass filter 310 and one or more transmission/reception lines 312.

The radio board 300 may communicate with other devices by way of a ZigBee protocol or other wireless protocol. Those other devices may include other control devices such as other universal wireless luminaire controllers 10, manual controls such as the dimming switch 214, gateways (not shown), and computing devices (not shown).

The radio board 300 may also include circuitry to couple the various components 302, 304, 306, 308, and 310 of the radio board 300. The radio board 300 circuitry may furthermore include transmit (TX) and receive (RX) paths and an integrated and hard-wired media access control (MAC) permanent unique identifier.

The microprocessor 302 may be any of a variety of microprocessors, including an ARM Cortex-M3 or M4 and may be embedded on a transceiver integrated circuit. A microcontroller may be used and operate as the microprocessor 302.

The crystal timer 304 is a device that creates an electrical signal with a precise frequency. The crystal timer 304 provides a stable clock signal to the radio transceiver 306 and ensures frequency accuracy of the transmit signal.

The radio transceiver 306 may be any of a variety of radio transceivers including a Silicon Labs EM35x, EFR32 or CSR CSR1010 model radio transceiver. The radio transceiver 306 may incorporate a radio frequency (RF) transceiver 306 with baseband modem, a hardwired MAC and the microprocessor 302 or a microcontroller. The radio transceiver 306 may have a single RF transmit (TX) and reception (RX) port, or may have a separate transmit output and a separate reception input operated by an external TX/RX switch. The radio transceiver 306 also has a clock input to receive a signal from the crystal timer 304.

The antenna 308 may be of various constructions and may, for example, take the form of an integrated Printed Circuit Board (PCB) trace antenna or an external antenna connected through pin(s) on the mini-module. There may furthermore be a common antenna 308 for both the transmit and receive functions or separate antennas for each of the transmit and receive functions.

The low-pass filter (LPF) 310 stops high frequency radio signals from being transmitted from the radio transceiver 306 and permits the desired frequencies to pass through the LPF 310 and be transmitted. The low-pass filter 310 may be included on the radio module between the radio transceiver 306 and the antenna 308.

Transmission lines are wires that connect the transceiver 306 to the antenna 308. Transmission lines may be arranged in various ways including a single transmission line connecting the transceiver 306 to the antenna 308, possible through the low-pass filter 310, or two transmission lines extending from the transceiver 306 connecting at a duplex junction (such as a TX/RX switch) and a third transmission line connecting that junction to the antenna 308.

The transmit/receive (TX/RX) switch switches between transmit and receive functions if the transceiver 306 is using separate transmit (TX) and receive (RX) circuits. The transmit/receive (TX/RX) switch may be included on the radio transceiver 306 in an integrated circuit type system, connected to the TX output and RX input of the radio transceiver 306.

A low noise amplifier (LNA) may be employed to amplify a received radio frequency (RF) signal. That low noise amplifier may be internal or external to an integrated circuit that includes the transceiver 306.

A power amplifier (PA) may also be incorporated in the radio board 300 to amplify a signal to be transmitted from the radio board 300. The power amplifier generally delivers high efficiency, high gain and high output power (for example the power output of the power amplifier may be equal to the signal received plus 20.0 dB) to provide an extended range and reliable transmission for fewer nodes in a network. The power amplifier may be internal or external to an integrated circuit that includes the transceiver 306.

In one embodiment, the universal wireless luminaire controller 10 can be used for wireless control of an LED fixture 212 with dimming. In such an embodiment, the universal wireless luminaire controller 10 may be configured with the components described hereinbefore and with the relay 16 coupled to the power input 206 of the LED driver 202. The LED driver 202 would have its LED power output 208 wired to the power input of one or more LED fixtures 212 in such an embodiment. When placed in its energized state, the relay 16 energizes the driver 202 the LED fixture 212, in many embodiments through the driver 202, and when placed in its de-energized state, the relay 16 de-energizes the LED fixture 212, possibly through the driver 202.

The first channel interface 18 of the universal wireless luminaire controller 10 in that embodiment may be coupled to the LED driver 202 input 204. The output signal of the universal wireless luminaire controller 10 first channel interface 18 may vary from 0-10V to dim or brighten one or more LED fixtures 212.

In that embodiment, the universal wireless luminaire controller 10 may be coupled to the manually actuated dimming control 214 wirelessly through the wireless radio module 14 such that a signal from a controller such as the manually actuated dimming control 214 may be received at the universal wireless luminaire controller 10 and a 0-10V signal that is commensurate with the signal received from the manually actuated dimming control 214 may be output from the first channel interface 18 of the universal wireless luminaire controller 10 to the LED driver 202 for control of the brightness of the LED fixture 212.

In another embodiment, the universal wireless luminaire controller 10 may have its second channel interface 20 coupled to the LED driver 202 such that a second light color signal may be received from the manually actuated dimming control 214 at the universal wireless luminaire controller 10. A 0-10V signal that is commensurate with the light color signal received from the manually actuated dimming control 214 may be output from the second channel interface 20 of the universal wireless luminaire controller 10 to the LED driver 202 for control of the color or warmth of light emanating from the LED fixture 212. In that embodiment, the manually actuated dimming control 214 may have a second control switch or lever, such as a manual slide control, that can be manually actuated to create the second light color signal and thereby vary the color of the light emanating from the LED fixture 212 from what is commonly referred to as a cool light to what is commonly referred to as a warm light.

The universal wireless luminaire controller 10 may control more than one LED fixture 212. For example, the controller may provide control signals for one or both of light intensity and light color to the LED driver 202 and the LED driver 202 may provide the appropriate power to an LED warm temperature fixture 212 and an LED cool temperature fixture 212 in parallel. Alternately, the universal wireless luminaire controller 10 may directly transmit a current commensurate with a desired intensity level and color to one or more LED fixtures 212.

In another embodiment, the universal wireless luminaire controller 10 provides a DALI signal to the LED driver 202 with instructions for one or both of lighting intensity and lighting color and the LED driver 202 provides a commensurate DC voltage to one or more LED fixtures 212.

Figure 5:
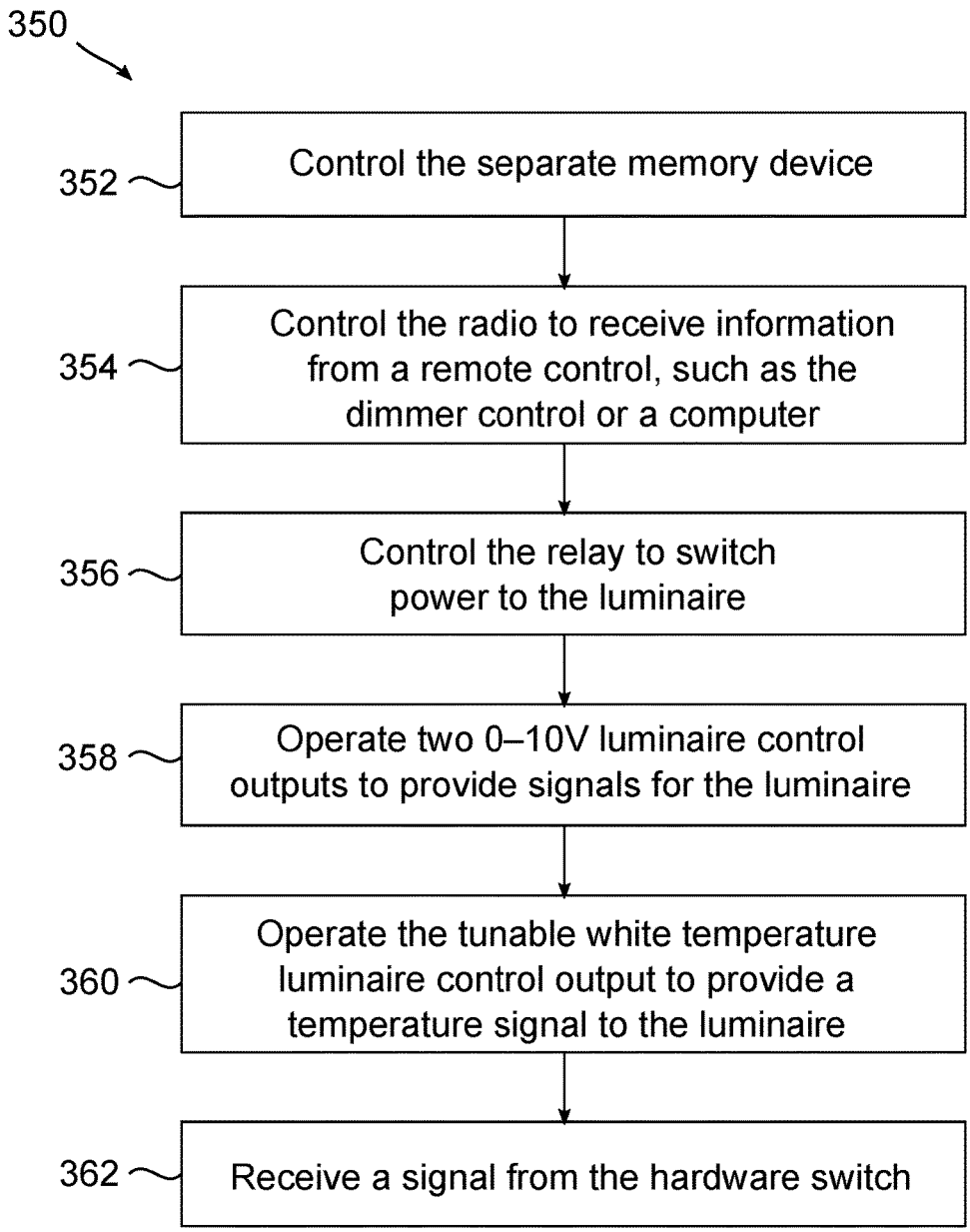
FIG. 5 illustrates an embodiment of a method of operating a universal wireless luminaire to control an LED luminaire fixture.

FIG. 5 illustrates a method 350 of operating a universal wireless luminaire 10 to control an LED luminaire fixture 212. That method 350 uses a single microcontroller 250 to control the separate memory device 252 at 352, to control the radio 254 to receive information from a remote control, such as the dimmer control 214 or a computer at 354, to control the relay 16 to switch power to the luminaire 212 at 356, to operate two zero to ten volt luminaire control outputs 18 and 20 at 358 to provide signals for the luminaire 212, to operate the tunable white temperature luminaire control output 22 to provide a temperature signal to the luminaire 212 at 360, and to receive a signal from the hardware switch 258 at 362.

The universal wireless luminaire controller 10 includes multiple signal generators such as, for example, the first channel interface that may provide a 0-10V control signal to control dimming or another function of the luminaire 212 or the luminaire driver 202, the second channel interface that may provide a 0-10V control signal to control temperature or another function of the luminaire 212, the tunable white temperature control interface 22 that may provide a temperature control signal that is other than a 0-10V signal to the luminaire 212 or luminaire driver 202, the digital lighting control protocol interface 24 that may provide communication of a signal to the luminaire 212 or the luminaire driver 202 through a digital lighting control protocol such as digital address lighting interface (DALI) protocol, the driver constant current output 30, and an LED DC output 32. It should also be noted that few luminaires 212 or luminaire drivers 202 will be coupled to all those signal generators. Rather, the variety of signal generators may be included in the universal wireless luminaire controller 10 so that the universal wireless luminaire controller 10 can operate with a wide variety of luminaires 212 and luminaire drivers 202.

The separate memory device 252 may operate to download instructions for the universal wireless luminaire controller 10 from the network 256 when it is energized and may, in turn, download operational instructions to the microcontroller 250 when the separate memory is energized. In that way if, for example, new software is to be loaded on the microcontroller 250, the loading process can be as simple as de-energizing and re-energizing the universal wireless luminaire controller 10.

The radio 300 may be configured to communicate with, receiving messages from and transmitting messages to, other devices on the network 256. For example, the may receive operating instructions for its microprocessor 302 from a gateway on the network, may receive a control signal from a remote wireless luminaire control device, such as a dimmer switch, and may transmit information, such as control commands and sensed status of its connected luminaire 212 through a mesh network.

The relay switches power to the luminaire 212 while the control outputs at 352-360 may be providing signals regarding qualities of the light emanating from the luminaire 212.

The hardware switch 258 may be used to energize and de-energize the universal wireless luminaire when the hardware switch 258 is actuated.

The first channel interface 18 and the second channel interface 20 may receive pulse width modulated signals from the single microcontroller 250 and convert those signals to 0-10V signals or another type of signal that is employed in the lighting control industry.

While specific embodiments of the invention have been described in detail, it should be appreciated by those skilled in the art that various modifications and alternations and applications could be developed in light of the overall teachings of the disclosure. Accordingly, the particular arrangements, apparatuses, and methods disclosed are meant to be illustrative only and not limiting as to the scope of the invention.

What is claimed is:

1. A wireless luminaire control device, comprising:

a single microcontroller;

a separate memory device coupled to the single microcontroller, the separate memory device containing instructions for operation of the single microcontroller;

a radio coupled to the single microcontroller for communication with a node on a wireless network;

a relay coupled to the single microcontroller for switching power for a luminaire;

a first microcontroller pulse width modulated output coupled to a first zero to ten volt driver interface to provide a first control signal for the luminaire;

a second microcontroller pulse width modulated output coupled to a second zero to ten volt driver interface to provide a color temperature control signal for the luminaire;

a third microcontroller pulse width modulated output coupled to a tunable white temperature control interface to provide a color control signal for the luminaire; and a hardware switch that causes the single microcontroller to execute instructions to join a wireless network when the hardware switch is actuated.

2. The wireless luminaire control device of claim 1, wherein the zero to ten volt driver transmits a 0-10V signal to an LED driver that controls brightness of the luminaire.

3. The wireless luminaire control device of claim 1, wherein the relay energizes and de-energizes the luminaire.

4. The wireless luminaire control device of claim 3, wherein the relay energizes and de-energizes the luminaire through a driver coupled to the luminaire.

5. The wireless luminaire control device of claim 1, wherein the separate memory device contains data received by the radio.

6. The wireless luminaire control device of claim 5, wherein the data contained by the separate memory device includes data received from the wireless network.

7. The wireless luminaire control device of claim 1, wherein the single microcontroller downloads software through the radio when the hardware switch is actuated.

8. The wireless luminaire control device of claim 1, wherein the first zero to ten volt driver interface provides a first zero to ten volt signal.

9. The wireless luminaire control device of claim 8, wherein the tunable white temperature control interface outputs a second zero to ten volt signal.

10. The wireless luminaire control device of claim 9, wherein the second zero to ten volt signal is transmitted to an LED fixture driver.

11. The wireless luminaire control device of claim 1, wherein the separate memory device contains instructions for operation of the single microcontroller.

12. The wireless luminaire control device of claim 1, wherein the wireless luminaire control device is coupled to the luminaire by one of the first zero to ten volt first control signal and the color temperature control signal but not the first control signal and the color temperature control signal.

13. The wireless luminaire control device of claim 1, further comprising a microcontroller input coupled to the first microcontroller pulse width modulated output.

14. The wireless luminaire control device of claim 13, wherein an input of the microcontroller and first microcontroller pulse width modulated output are wired in parallel to a control input of an LED driver.

15. The wireless luminaire control device of claim 14, wherein a voltage sensed at the microcontroller input indicates that the driver accepts a control input.

16. A method of controlling a universal wireless luminaire, comprising:

controlling a separate memory device, a radio, a relay for switching power to an LED luminaire, two zero to ten volt luminaire control outputs, a tunable white temperature luminaire control output, and a hardware switch with a single microcontroller;

the separate memory device downloading operational instructions to the single microcontroller when the single microcontroller and separate memory are energized;

the radio receiving a control signal from a remote wireless luminaire control device;

the relay switching power to the luminaire; and the hardware switch alternately energizing and de-energizing the universal wireless luminaire when the hardware switch is actuated.

17. The method of controlling a universal wireless luminaire of claim 16, wherein the two zero to ten volt luminaire control outputs, and the tunable white temperature luminaire control output provide signals to a driver, the driver providing power to an LED luminaire.

18. The method of controlling a universal wireless luminaire of claim 16, wherein fewer than all of the two zero to ten volt luminaire control outputs, and the tunable white temperature luminaire control output are coupled to control the luminaire.

19. The method of controlling a universal wireless luminaire of claim 16, wherein the radio receives the control signal from a manual wall mounted wireless luminaire control device.

20. The method of controlling a universal wireless luminaire of claim 16, wherein the radio receives the control signal from a computing device.

* * * * *